US012497720B2

(12) United States Patent
Vela

(10) Patent No.: US 12,497,720 B2
(45) Date of Patent: Dec. 16, 2025

(54) CROCHET ASSISTANCE APPARATUS

(71) Applicant: James Edward Vela, Maitland, FL (US)

(72) Inventor: James Edward Vela, Maitland, FL (US)

( * ) Notice: Subject to any disclaimer, the term of this patent is extended or adjusted under 35 U.S.C. 154(b) by 0 days.

(21) Appl. No.: 19/011,076

(22) Filed: Jan. 6, 2025

(65) Prior Publication Data

US 2025/0137178 A1 May 1, 2025

Related U.S. Application Data

(63) Continuation-in-part of application No. 18/671,464, filed on May 22, 2024, now Pat. No. 12,247,333.

(60) Provisional application No. 63/470,284, filed on Jun. 1, 2023.

(51) Int. Cl.
*D04B 33/00* (2006.01)
*D04B 3/00* (2006.01)
*D04B 31/00* (2006.01)

(52) U.S. Cl.
CPC ..... *D04B 33/00* (2013.01); *D04B 3/00* (2013.01); *D04B 31/00* (2013.01)

(58) Field of Classification Search
CPC ... D04B 3/04; D04B 3/06; D04B 3/00; D04B 5/00; D04B 39/00; D04B 33/00; D04B 36/00; D04B 31/00
See application file for complete search history.

(56) References Cited

U.S. PATENT DOCUMENTS 1,168,554 A * 1/1916 Riley ..... D04B 17/00 66/1 R
1,208,085 A * 12/1916 Branley ..... B65H 57/04 242/153
1,473,953 A * 11/1923 Dart ..... D05B 91/04 D3/29
2,072,668 A * 3/1937 Eltgroth ..... D04B 17/00 D15/66
2,142,608 A * 1/1939 Hockert ..... D04B 3/00 66/1 A
2,434,609 A * 1/1948 Coffey ..... D04B 3/00 43/25
2,524,157 A * 10/1950 Beirer ..... D04B 3/00 242/157 R (Continued)

*Primary Examiner* — Danny Worrell
(74) *Attorney, Agent, or Firm* — PATENTFILE, LLC; Bradley C. Fach; Steven R. Kick

(57) ABSTRACT

A crochet assistance apparatus for supporting a flexible filament may include a first plurality of elongated projections and a second plurality of elongated projections, and may be movable between a first position and a second position. Each elongated projection of the first plurality of elongated projections may be proximate to the second plurality of elongated projections when the apparatus is in the first position, and one or more elongated projections of the first plurality of elongated projections may be moved out of being proximate to the second plurality of elongated projections when the apparatus is in the second position. The first plurality of elongated projections may be coupled to a first panel, and the second plurality of elongated projections may be coupled to a second panel. The panels may be relatively closer to each other in the first position and relatively farther from each other in the second position.

19 Claims, 7 Drawing Sheets

(56) References Cited

U.S. PATENT DOCUMENTS 3,717,012 A * 2/1973 Misner ..... D04C 3/00 66/1 A
3,967,467 A * 7/1976 Leach, Sr. ..... D04B 3/00 66/4
4,193,273 A * 3/1980 Palange ..... D04B 39/00 66/4
4,248,063 A * 2/1981 Wang ..... D04B 3/00 66/4
4,370,870 A * 2/1983 Kroh ..... D04B 3/00 66/1 A
4,393,668 A * 7/1983 Leach, Sr. ..... D04B 5/00 66/4
4,729,229 A * 3/1988 Whicker ..... D04B 3/00 66/4
5,125,245 A * 6/1992 Kuwabara ..... D04B 3/04 16/225
5,231,742 A * 8/1993 Macbain ..... D03D 29/00 28/151
6,449,987 B1 * 9/2002 Poole ..... D04B 3/00 66/1 A
7,506,524 B2 * 3/2009 Gustin ..... D04B 5/00 66/1 A
7,578,146 B2 * 8/2009 Gustin ..... D04B 5/00 66/1 A
8,402,794 B2 * 3/2013 Sasur ..... D04B 3/00 66/3
8,596,096 B1 * 12/2013 Russell ..... D04B 5/00 66/4
8,684,420 B2 * 4/2014 Ng ..... D04D 11/00 289/17
8,931,811 B1 * 1/2015 Ng ..... A44C 5/0069 289/17
8,973,955 B2 * 3/2015 Ng ..... D04D 7/04 289/17
9,234,306 B1 * 1/2016 Chang ..... D04B 3/00
9,903,055 B2 * 2/2018 Todokoro ..... D04B 5/00
12,247,333 B2 * 3/2025 Edward Vela ..... D04B 33/00
2008/0156043 A1 * 7/2008 Gustin ..... D04B 5/00 66/4
2012/0047960 A1 * 3/2012 Sasur ..... D04B 3/00 66/1 A
2016/0032500 A1 * 2/2016 Novak ..... D04B 5/00 28/152
2023/0183895 A1 * 6/2023 Thorsen ..... D04B 3/04 66/1 A

* cited by examiner

CROCHET ASSISTANCE APPARATUS

CROSS REFERENCE TO RELATED APPLICATIONS

This application is a continuation-in-part of U.S. Non-Provisional application Ser. No. 18/671,464, filed on May 22, 2024, entitled "CROCHET ASSISTANCE APPARATUS", which claims the benefit of U.S. Provisional Patent Application No. 63/470,284, filed on Jun. 1, 2023, entitled "CROCHET ASSIST APPARATUS", the entire disclosures of which are incorporated by reference herein.

FIELD OF THE INVENTION

This patent specification relates to the field of crocheting yarn or other malleable filaments. More specifically, this patent specification relates to a crochet assistance apparatus which enables an individual with movement deficiency in a body part or extremity, e.g., fingers, hands, arms, shoulder, etc., to be able to crochet with pace and accuracy to make the activity enjoyable and fruitful.

BACKGROUND

Crocheting is a very specific art of manipulating yarn and other flexible filaments into various knotted patterns to produce a stretch of material which can be used for clothing, blankets, holders, cloth coverings, or any other product the imagination produces. The various knotted patterns are known as crochet stitches. A row is a series of numbered stitches. Once a crocheter reaches the end of the row, i.e., completes a desired number of stitches, some products are reversed, i.e., flipped direction, and the "next" row is started on the reverse side to create stitches that are unique to crocheting. Other products will continue in a contiguous line or circular pattern to create stitches that are unique to crocheting. This pattern is repeated until the desired number of rows is achieved. Crocheting differs from knitting and other yarn and flexible filament manipulating arts as crocheting is performed with two human hands, a bundle of yarn, and a crochet needle. Each hand has very specific tasks while crocheting. Because crocheting can be performed by either a "right" handed or "left" handed artist the terms "yarn hand" and "needle hand" will allow for ambidextrous nomenclature. This is not to imply that a crocheter could simply switch tasks between hands. Switching the yarn hand with the needle hand or vice versa is as practical as switching which hand one writes with. The needle hand holds a crochet needle, a long handheld cylindrical tool of various thickness with a hook at one end which will aid in manipulating the yarn or other malleable filament into various knotted patterns. The yarn hand provides structure, support, and guidance from the bundle of yarn to the completed product. The yarn hand must provide exacting structure, support, and guidance by fashioning the human fingers into various structures. These various structures require agility, dexterity, stamina, and proper human hand/finger placement knowledge to create the knotted patterns at a pace which makes crocheting an enjoyable task. The yarn hand must 1) hold the completed structure in a usable position, 2) provide support of the yarn for the needle to penetrate the next stitch, and 3) provide yarn guidance so the needle may have the appropriate approach for attack.

Due to illness, injury, or other maladies, one may find their ability to use their needle hand or their yarn hand diminished. At current, there are obvious and existing techniques that will aid those with needle hand deficiencies. Using a simple heavy structure in which a crochet needle is fastened, the artist will use the yarn hand to manipulate the yarn around the statically held needle.

There does not exist an aid, apparatus, structure, or technique that can help those with yarn hand deficiencies. The complexity of tasks the yarn hand must perform simultaneously requires an apparatus that provides 1) structure, 2) support, and 3) guidance with an easy-to-use interface. Beginning crocheters have a steep learning curve to develop the agility, dexterity, stamina, and proper hand/finger placement knowledge of their yarn hand to properly crochet with ease and enjoyment. Existing crocheters may see a decrease in agility, dexterity, or stamina in their hands over time. This is an effort to allow new and existing crocheters the ability to begin or continue their desire to crochet for whatever reason they may have.

My mother, Leticia, is left side hemiplegic due to a stroke and lost the ability to crochet, among other activities. My mother lost one-hundred percent ability to use her yarn hand. My mother has a longing towards enjoying this art again to some degree. I promised her I would attempt to create an apparatus that could help her. I taught myself how to crochet and this apparatus is an effort to allow my mother and others to gain some independence and enjoyment in this art lost to illness, injury, or other maladies.

Therefore, a need exists for novel crochet assistance apparatuses. A further need exists for novel crochet assistance apparatuses which enables a user to crochet and perform like activities to gain some independence and enjoyment in this art that may have been otherwise lost to illness, injury, or other maladies.

BRIEF SUMMARY OF THE INVENTION

A crochet assistance apparatus for supporting a flexible filament is provided which enables a user to crochet and perform like activities to gain some independence and enjoyment in this art that may have been otherwise lost to illness, injury, or other maladies.

In some embodiments, the apparatus may include a first plurality of elongated projections and a second plurality of elongated projections. The apparatus may be movable between a first position and a second position. Each elongated projection of the first plurality of elongated projections may be proximate to the second plurality of elongated projections when the apparatus is in the first position, and one or more elongated projections of the first plurality of elongated projections may be moved out of being proximate to the second plurality of elongated projections when the apparatus is in the second position. The first plurality of elongated projections may be coupled to a first panel, and the second plurality of elongated projections may be coupled to a second panel. A portion of the first panel may be relatively closer to the second panel when the apparatus is in the first position, and the portion of the first panel may be relatively farther from the second panel when the apparatus is in the second position. In use, a flexible filament may be moved into contact with the first and second plurality of elongated projections. The first and second plurality of elongated projections may provide support and positioning of the flexible filament as a crochet needle penetrates the working stitch to allow the user to generate a row of a desired number of stitches.

In some embodiments, the apparatus may include a glove having a glove thumb and a glove finger. The first panel may be coupled to the glove thumb, and the second panel may be coupled to the glove finger.

In some embodiments, the apparatus may include a guide assembly having a guide aperture that extends above both the first plurality of elongated projections and the second plurality of elongated projections.

In some embodiments, the apparatus may include a tensioner assembly that may be configured to receive the flexible filament. The tensioner assembly may have a first filament contact surface, a second filament contact surface, and a third filament contact surface, and the tensioner assembly may exert a resistance to the flexible filament moving through the tensioner assembly.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
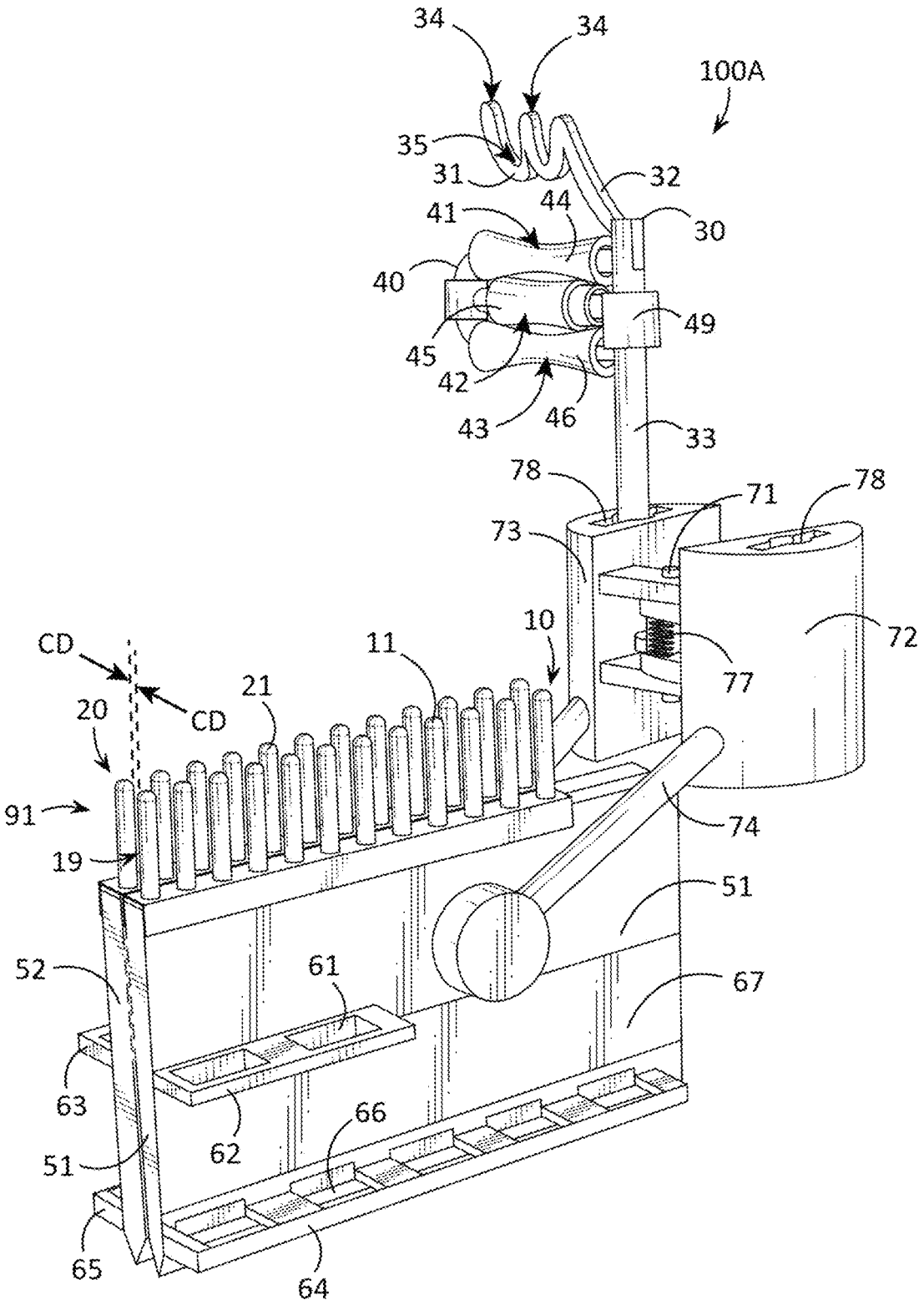
FIG. 1 depicts a top perspective view of an example of a crochet assistance apparatus in a first or closed position according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 20% of the specified number. Additionally, as used in this application, the term "substantially" means that the actual value is within about 10% of the actual desired value, more preferably within about 5% of the actual desired value and even more preferably within about 1% of the actual desired value of any variable, element or limit set forth herein.

A new crochet assistance apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1, 2, and 5-8 illustrate examples of a crochet assistance apparatus ("the apparatus") 100A, 100B, according to various embodiments.

The apparatus 100A, 100B, may be used to support a flexible filament 200 to facilitate a user's ability to manipulate the flexible filament 200, such as for performing crochet activities. Preferably, the apparatus 100A, 100B, may perform one or more, such as all, the functions of a user's "yarn hand" during the performance of crochet and other flexible filament 200 manipulating activities.

Figure 2:
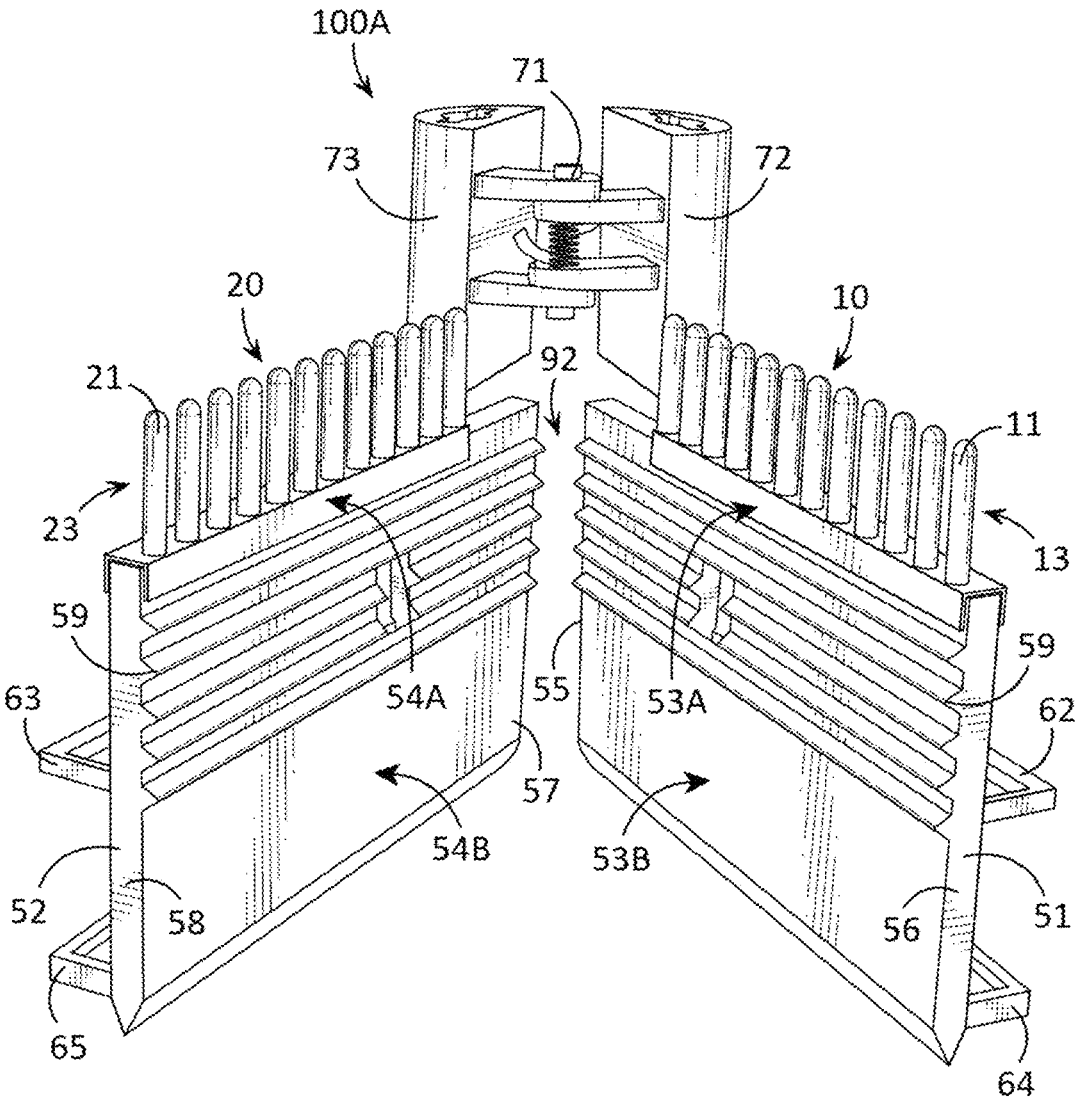
FIG. 2 illustrates a top perspective view of an example of a crochet assistance apparatus in a second position or open according to various embodiments described herein.
Figure 8:
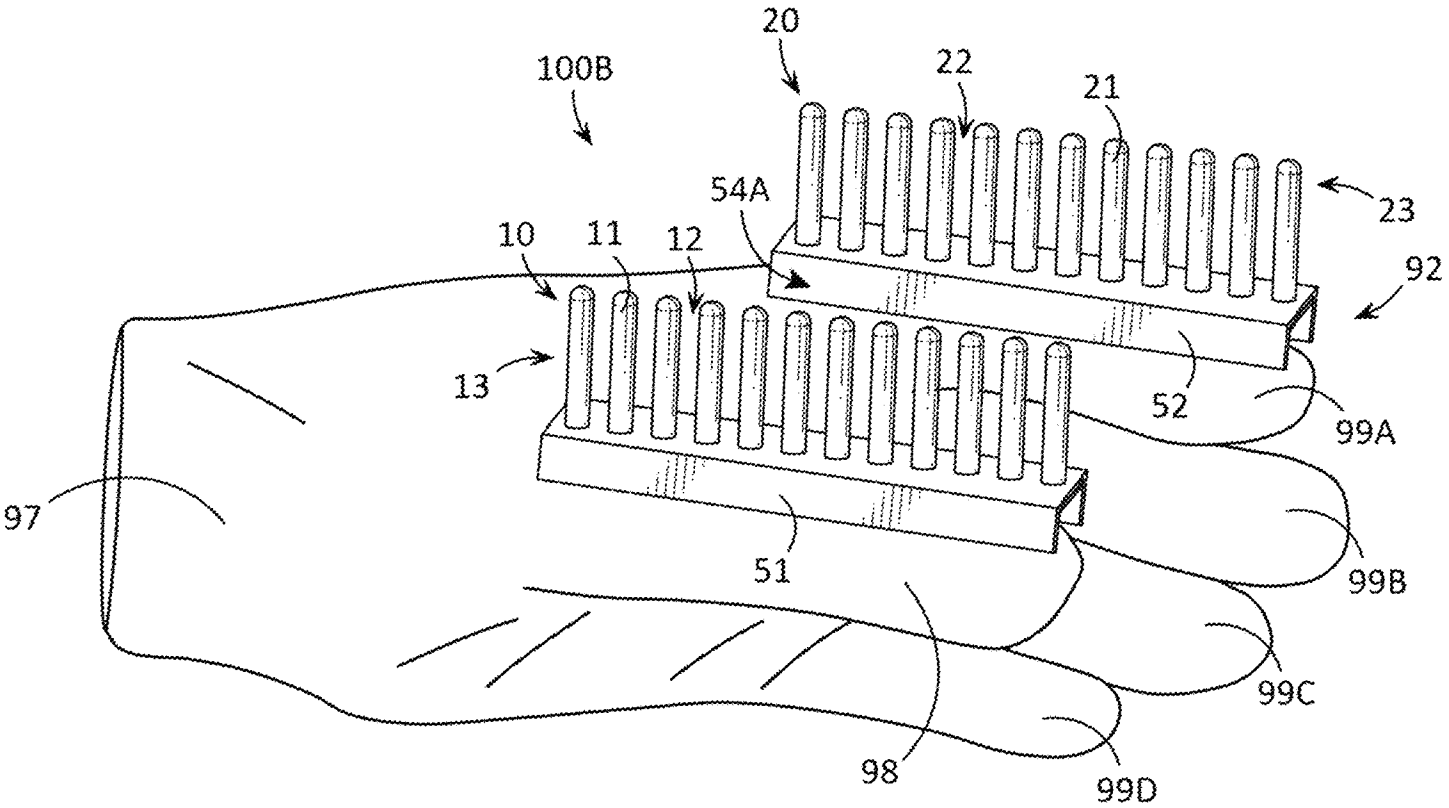
FIG. 8 illustrates a top perspective view of a further example of a crochet assistance apparatus in a second position or open according to various embodiments described herein.

In some embodiments, the apparatus 100A, 100B, may comprise a first plurality of elongated projections 10 and a second plurality of elongated projections 20. The first plurality of elongated projections 10 may be coupled to a first panel 51, and the second plurality of elongated projections 20 may be coupled to a second panel 52. The apparatus 100A, 100B, may be movable between a first position 91 (FIGS. 1, 5, 6, and 7) and a second position 92 (FIGS. 2 and 8). When the apparatus 100A, 100B, is in the first position 91, the first plurality of elongated projections 10 and the second plurality of elongated projections 20 may be relatively closer together, and when the apparatus 100A, 100B, is in the second position 92, the first plurality of elongated projections 10 and the second plurality of elongated projections 20 may be relatively farther apart. In use, a flexible filament 200 may be moved into contact with the first 10 and second 20 plurality of elongated projections, and the first 10 and second 20 plurality of elongated projections may provide support and positioning of the flexible filament 200 as a crochet needle 300 penetrates the working stitch to allow the user to generate a row of a desired number of stitches.

The apparatus 100A, 100B, may comprise a first plurality of elongated projections 10 that may be made up of any number of individual elongated projections 11, such as between five and 500 individual elongated projections 11. Similarly, the apparatus 100A, 100B, may comprise a second plurality of elongated projections 20 that may be made up of any number of individual elongated projections 21, such as between five and 500 individual elongated projections 21. Generally, the first plurality of elongated projections 10 and the second plurality of elongated projections 20 may be used to provide backing support for the working stitch of a working product 201 and may replace or function as one or more of the users the fingers that hold the working stitch in place while the needle 300 manipulates the yarn or flexible filament 200. For example, the first plurality of elongated projections 10 and the second plurality of elongated projections 20 may each comprise a series of outstretched rubberized, flexible, yet firm, elongated nodules that allow the attacking needle 300 unfettered access to the working stitch.

Figure 3:
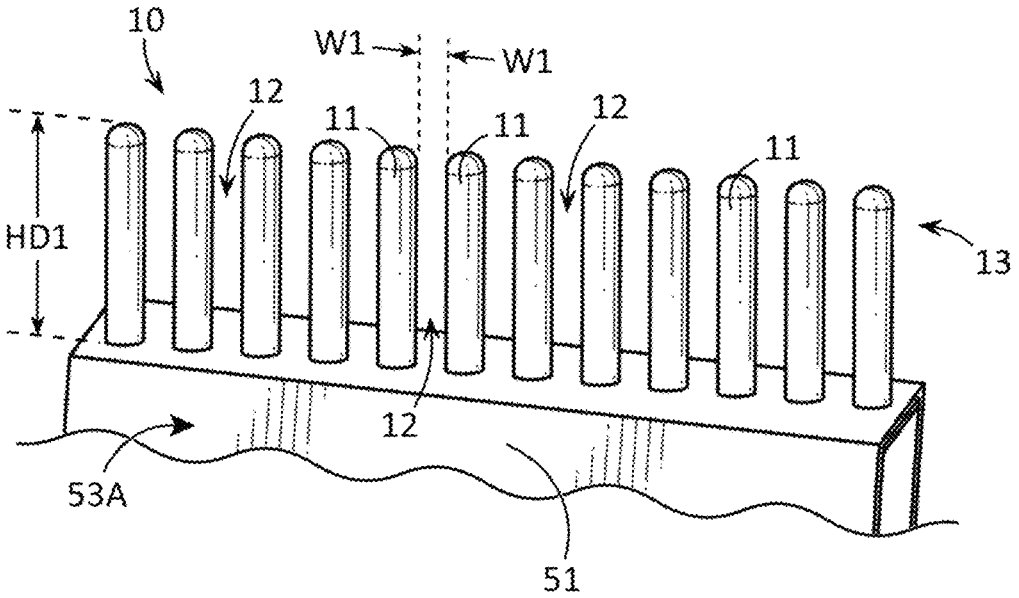
FIG. 3 shows a perspective view of an example of a first plurality of elongated projections that is coupled to an example of a first panel according to various embodiments described herein.
Figure 4:
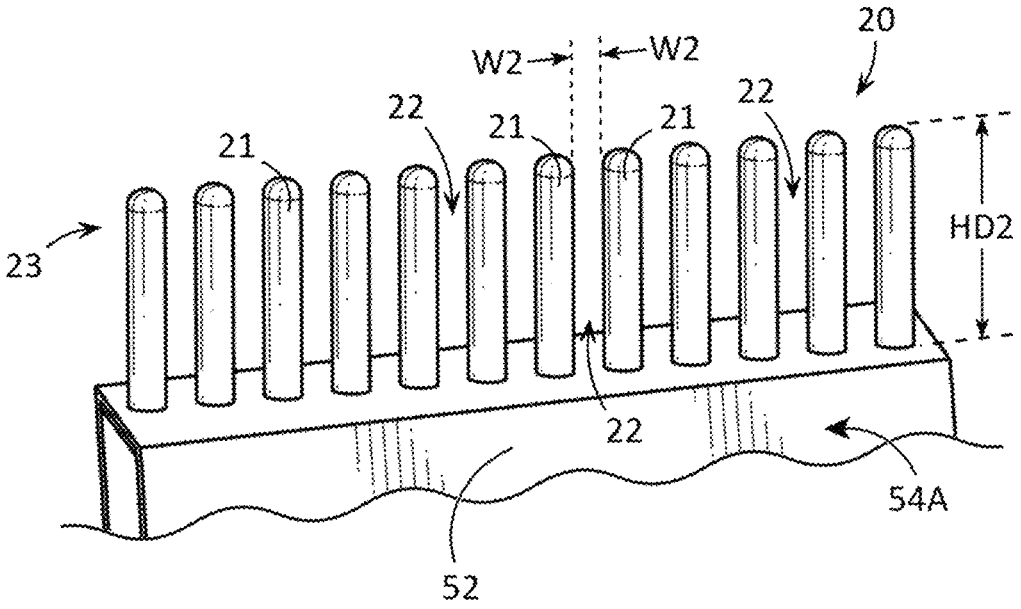
FIG. 4 depicts a perspective view of an example of a second plurality of elongated projections that is coupled to an example of a second panel according to various embodiments described herein.
Figure 5:
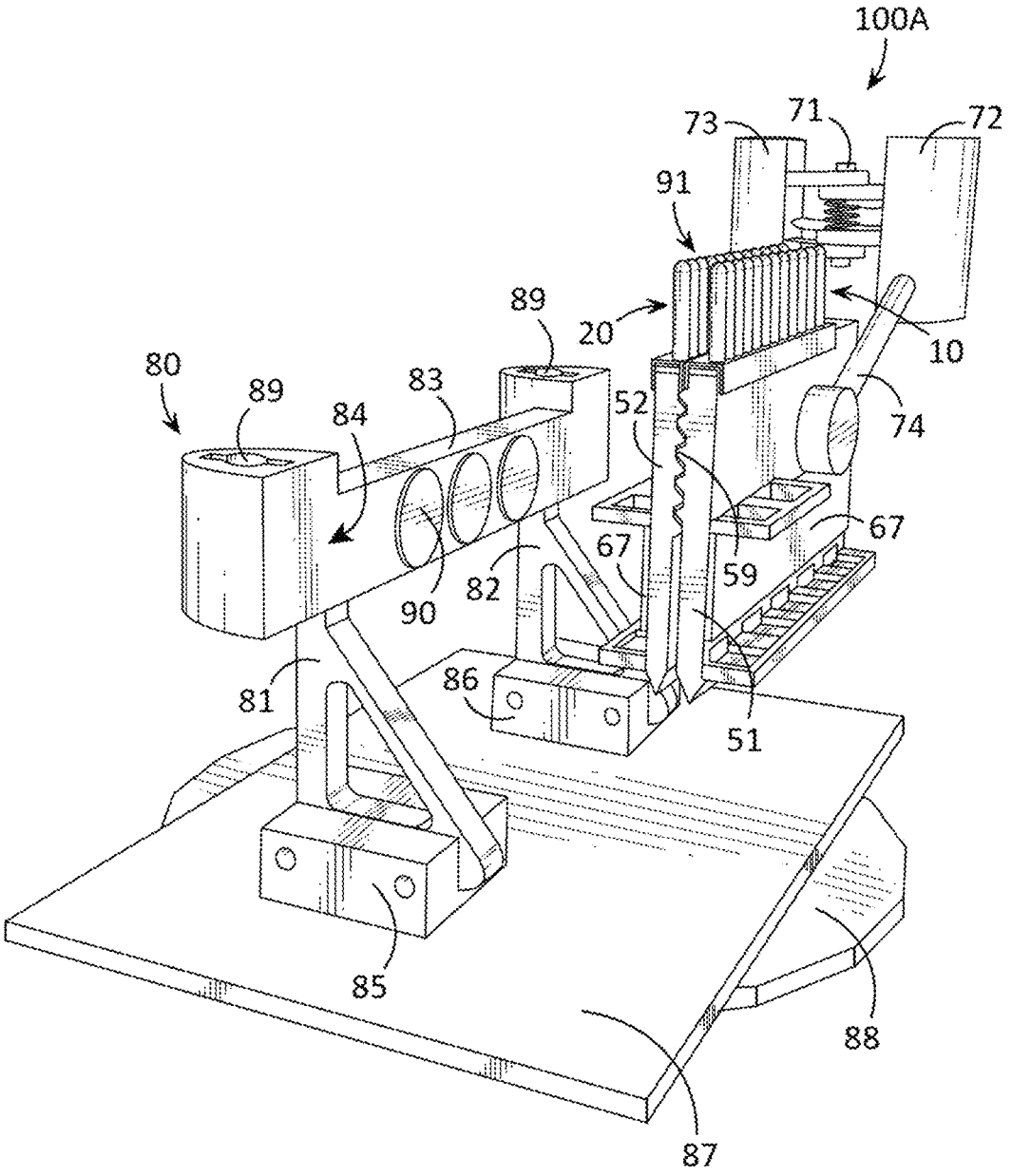
FIG. 5 illustrates a top front perspective view of another example of a crochet assistance apparatus in a first position according to various embodiments described herein.
Figure 6:
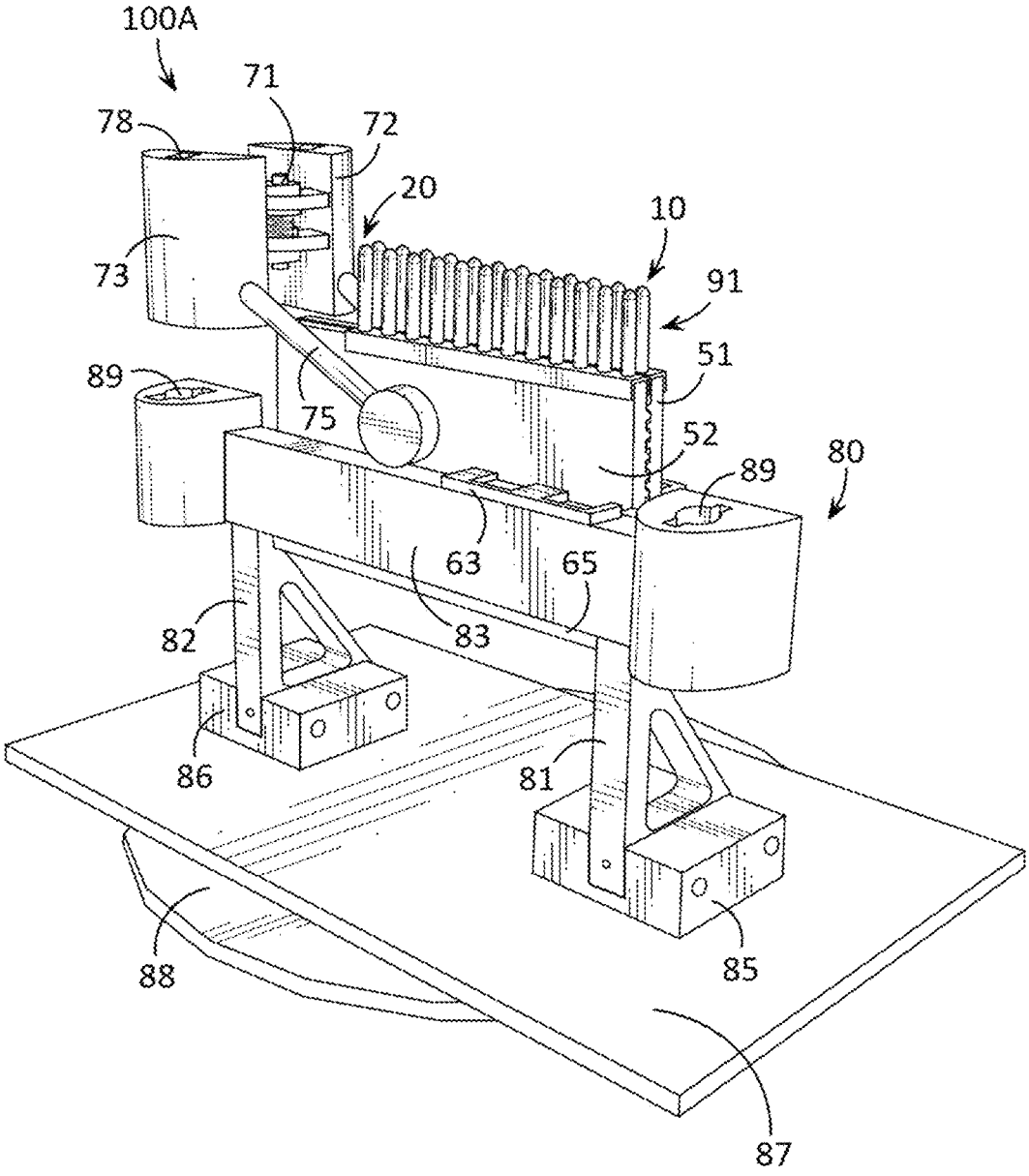
FIG. 6 shows a top rear perspective view of another example of a crochet assistance apparatus in a first position according to various embodiments described herein.
Figure 7:
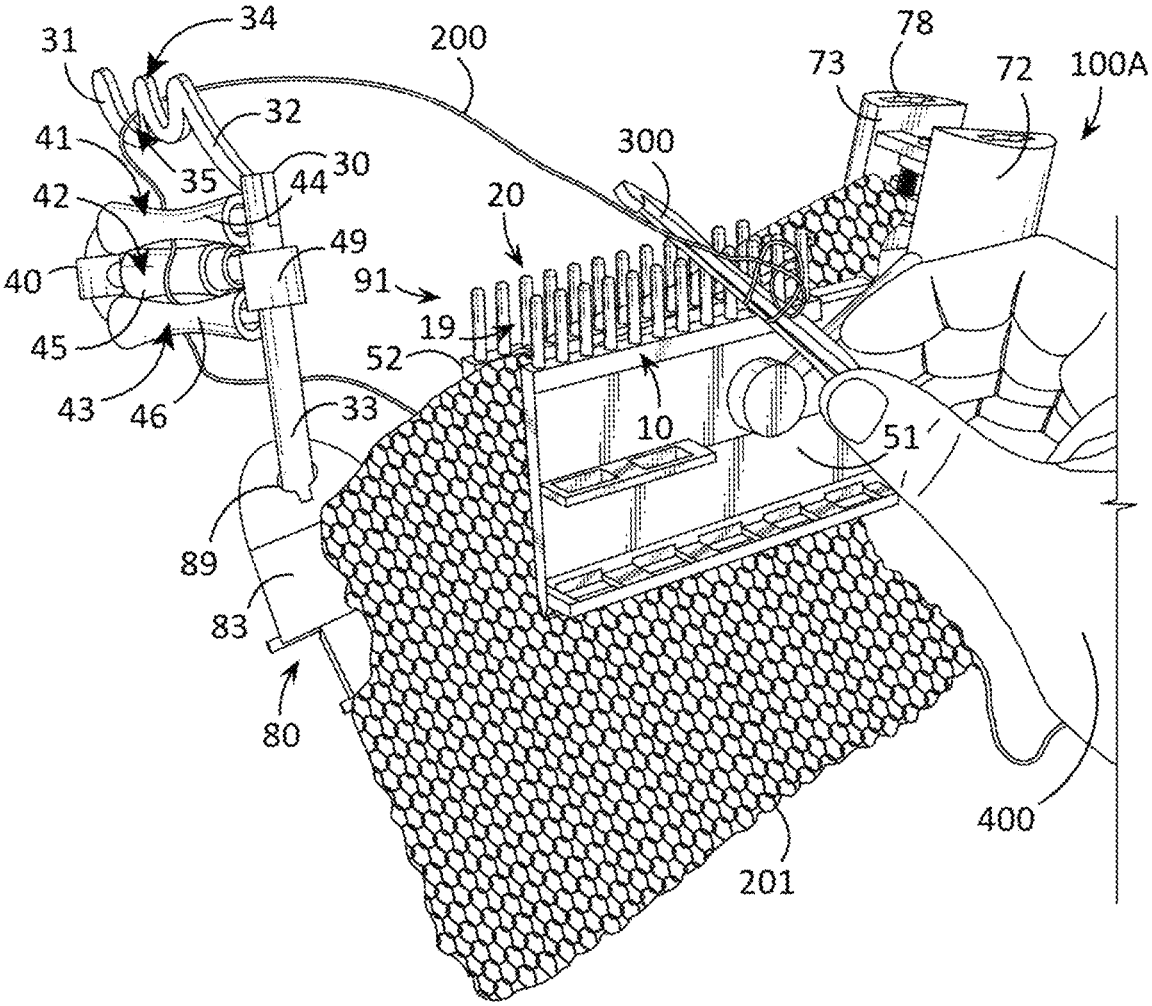
FIG. 7 depicts a top perspective view of an example of a crochet assistance apparatus being used to turn a flexible filament into a working or crocheted product according to various embodiments described herein.

Elongated projections 11, 21, may have an elongated shape, having a height dimension (HD1 in FIG. 3 and HD2 in FIG. 4) that may be substantially greater than their width and length dimensions. Preferably, elongated projections 11, 21, may have a height dimension HD1, HD2, of between 0.2 inches and 2.0 inches, and more preferably a height dimension HD1, HD2, of between 0.5 inches and 1.0 inches. Preferably, elongated projections 11, 21, may have a straight or linear elongated shape. In some embodiments, elongated projections 11, 21, may comprise an elongated cylindrical shape, an elongated rectangular prism shape, an elongated triangular prism shape, an elongated hexagonal prism shape, etc. It should be understood that elongated projections 11, 21, may be configured in any shape and size.

In some embodiments, one or more elongated projections 11, 21, may be generally flexible and may be made from or may comprise a resilient material that may be flexible to allow slight deformation and resilient so as to return to its original shape after deformation. In preferred embodiments, elongated projections 11, 21, may be made from or comprise a flexible material such as natural and/or synthetic rubber material such as latex rubber, silicone foam, silicone rubber, rubber foam, urethane foam, plastic foam, neoprene foam, latex foam rubber, polyurethane foam rubber, forms of the organic compound isoprene, Polyacrylate Rubber, Ethylene-acrylate Rubber, Polyester Urethane, flexible plastics, such as high-density polyethylene (HDPE), polyvinyl chloride (PVC), polypropylene (PP), Polystyrene (PS), Polycarbonate (PC), low density polyethylene (LDPE), or any other flexible material including combinations of materials. In preferred embodiments, each elongated projection 11 in the first plurality of elongated projections 10 and each elongated projection 21 in the second plurality of elongated projections 20 may comprise a resilient material.

Each elongated projection 11 in the first plurality of elongated projections 10 may be separated from an adjacent elongated projection 11 by a space 12 so that each elongated projection 11 may be spaced apart from its adjacent elongated projection(s) 11. In preferred embodiments, a space 12 may comprise an elongated space or channel of between 0.1 to 1.0 inches in width (shown by W1 in FIG. 3), and more preferably an elongated space or channel of between 0.1 to 0.7 inches in width. Likewise, each elongated projection 21 in the second plurality of elongated projections 20 may be separated from an adjacent elongated projection 21 by a space 22 so that each elongated projection 21 may be spaced apart from its adjacent elongated projection(s) 21. In preferred embodiments, a space 22 may comprise an elongated space or channel of between 0.1 to 1.0 inches in width (shown by W2 in FIG. 4), and more preferably an elongated space or channel of between 0.1 to 0.7 inches in width.

In some embodiments, the elongated projections 11 in the first plurality of elongated projections 10 may be uniformly spaced apart (as perhaps best shown in FIGS. 1, 3, 4, and 8), such that all the spaces 12 between the elongated projections 11 may be substantially the same size (all W1 measurements are substantially the same size). In some embodiments, the elongated projections 21 in the second plurality of elongated projections 20 may be uniformly spaced apart (as perhaps best shown in FIGS. 1, 3, 4, and 8), such that all the spaces 22 between the elongated projections 21 may be substantially the same size (all W2 measurements are substantially the same size). In further embodiments, all the spaces 12 between the elongated projections 11 of the first plurality of elongated projections 10 may be substantially the same size as all the spaces 22 between the elongated projections 21 of the second plurality of elongated projections 20 (all W1 and W2 measurements are substantially the same size) as perhaps best shown in FIGS. 1, 3, 4, and 8.

In some embodiments, the elongated projections 11 in the first plurality of elongated projections 10 may be arranged in a first linear array 13 (as perhaps best shown in FIGS. 1, 3, 4, and 8). In some embodiments, the elongated projections 21 in the second plurality of elongated projections 20 may be arranged in a second linear array 23 (as perhaps best shown in FIGS. 1, 3, 4, and 8). In some embodiments, a linear array 13, 23, may be straight linear in shape, such that all elongated projections 11, 21, in the linear array 13, 23, may substantially be aligned in a straight line (e.g., a straight row) as perhaps best shown in FIGS. 1, 3, 4, and 8. For example, all elongated projections 11 of a first plurality of elongated projections 10 may be arranged in a first linear array 13 such that all the all elongated projections 11 are within a straight line, optionally the straight line having a width of less than 0.1 inches. In some embodiments, the elongated projections 11 in the first plurality of elongated projections 10 may be arranged in a first linear array 13, the elongated projections 21 in the second plurality of elongated projections 20 may be arranged in a second linear array 23, and the first linear array 13 and the second linear array 23 may be substantially parallel to each other when the apparatus 100A, 100B, is in the first position 91.

In some embodiments, a linear array 13, 23, may be curved linear in shape, such that all elongated projections 11, 21, in the linear array 13, 23, may substantially be aligned in a curved line (e.g., a curved row). For example, all elongated projections 11 of a first plurality of elongated projections 10 may be arranged in a first linear array 13 such that all the all elongated projections 11 are within a curved line, optionally the curved line having a width of less than 0.1 inches, and the curved line forming an arc of a circle. In some embodiments, a linear array 13, 23, that may be curved linear in shape may be curved from a range of 180-degree angle to a 360-degree angle. A linear array 13, 23, that may be curved linear in shape may allow the user additional customization for creating different shaped crocheted items, e.g., hats that are created using a continuous stitch.

In some embodiments, each elongated projection 11 of the first plurality of elongated projections 10 may be proximate (within 0.1 to 0.5 inches) to the second plurality of elongated projections 20 when the apparatus 100A, 100B, is in the first position 91, and one or more elongated projections 11 of the first plurality of elongated projections 10 may be moved out of being proximate the second plurality of elongated projections 20 when the apparatus 100A, 100B, is in the second position 92. For example, the first plurality of elongated projections 10 and second plurality of elongated projections 20 may be movably coupled together via a hinge 71 positioned proximate to one end of the first plurality of elongated projections 10 and positioned proximate to one end of the second plurality of elongated projections 20 so that the opposing ends may open away from each other in the second position 92 while the ends of the first 10 and second 20 plurality of elongated projections that are proximate to the hinge 71 may remain proximate to each other in both positions 91, 92.

In some embodiments, each elongated projection 11 of the first plurality of elongated projections 10 may be proximate to the second plurality of elongated projections 20 when the apparatus 100A, 100B, is in the first position 91, and each elongated projections 11 of the first plurality of elongated projections 10 may be moved out of being proximate with the second plurality of elongated projections 20 when the apparatus 100A, 100B, is in the second position 92. For example, the first plurality of elongated projections 10 and second plurality of elongated projections 20 may be removably coupled together, such as via threaded fasteners, magnets, or other removable coupling device, so that the first plurality of elongated projections 10 and second plurality of elongated projections 20 may be separate from each other when the apparatus 100A, 100B, is in the second position 92. As another example, the apparatus 100A, 100B, may comprise a hinge 71 that may be positioned below the first 10 and second 20 plurality of elongated projections so that when the apparatus is in the second position 92, all the elongated projections 11 of the first plurality of elongated projections 10 may be moved out of being proximate with the second plurality of elongated projections 20 when the apparatus 100A, 100B, is in the second position 92.

In some embodiments, the first plurality of elongated projections 10 may be coupled to a first panel 51 and the second plurality of elongated projections 20 may be coupled to a second panel 52. Generally, panels 51, 52, may hold and provide structure for the working product 201 as it is moved down and away from the pluralities of elongated projections 10, 20. The panels 51, 52, may replace or function as the user's hand which holds the crocheted working product 201. For example, the panels 51, 52, may comprise two smooth, flat panels that hold the crocheted working product 201 between the panels 51, 52.

In some embodiments, the apparatus 100A, 100B, may comprise a first panel 51, and the first plurality of elongated projections 10 may be coupled to the first panel 51. The elongated projections 11 of the first plurality of elongated projections 10 may be coupled to the first panel 51 so that the elongated height dimension of the elongated projections 11 extend away from and above the first panel 51. In further embodiments, the apparatus 100A, 100B, may comprise a second panel 52, and the second plurality of elongated projections 20 may be coupled to the second panel 52. The elongated projections 21 of the second plurality of elongated projections 20 may be coupled to the second panel 52 so that the elongated height dimension of the elongated projections 21 extend away from and above the second panel 52. By moving all or portions of a first panel 51 to be proximate to a second panel 52, all or portions each of the plurality of elongated projections 10, 20, coupled to each panel 51, 52, may likewise be moved proximate to each other when the apparatus 100A, 100B, is in the first position 91. By moving all or portions of a first panel 51 out of being proximate to a second panel 52, all or portions each of the plurality of elongated projections 10, 20, coupled to each panel 51, 52, may likewise be moved out of being proximate to each other when the apparatus 100A, 100B, is in the second position 92.

A panel 51, 52, may be configured in any size and shape. In preferred embodiments, a first panel 51 may comprise an elongated shape that is elongated between a first end 55 and a second end 56 to support the elongated projections 11 of the first plurality of elongated projections 10 being arranged in a first linear array 13 which preferably may extend between the first end 55 and second end 56. In preferred embodiments, a second panel 52 may comprise an elongated shape that is elongated between a first end 57 and a second end 58 to support the elongated projections 21 in the second plurality of elongated projections 20 being arranged in a second linear array 23 which preferably may extend between the first end 57 and second end 58.

In some embodiments, the first panel 51 may be relatively closer, such as by being proximate (within 0.1 to 0.5 inches), to the second panel 52 when the apparatus 100A, 100B, is in the first position 91, and the first panel 51 may be relatively farther from the second panel 52 when the apparatus 100A, 100B, is in the second position 92. For example, the first panel 51 and second panel 52 may be removably coupled together, such as via threaded fasteners, magnets, or other removable coupling apparatus 100A, 100B, so that the first panel 51 and second panel 52 may be separate from each other when the apparatus 100A, 100B, is in the second position 92. As another example, the apparatus 100A, 100B, may comprise a hinge 71 that may be coupled to the panels 51, 52, below the first 10 and second 20 plurality of elongated projections so that when the apparatus 100A, 100B, is in the second position 92, the upper portions of the panels 51, 52, that are proximate to the first 10 and second 20 pluralities of elongated projections may be moved out of being proximate with each other when the apparatus 100A, 100B, is in the second position 92.

In some embodiments, a portion of the first panel 51 may be relatively closer to the second panel 52 when the apparatus 100A, 100B, is in the first position 91, and the portion of the first panel 51 may be relatively farther from the second panel 52 when the apparatus 100A, 100B, is in the second position 92. For example, the first panel 51 and second panel 52 may be movably coupled together via a hinge 71 positioned proximate to the first ends 55, 57, of the panels 51, 52, so that the opposing second ends 56, 58, of the panels 51, 52, may open away from each other in the second position 92 while the first ends 55, 57, that are proximate to the hinge 71 may remain proximate to each other in both positions 91, 92.

A panel 51, 52, may comprise one or more work surfaces 53A, 53B, 54A, 54B, which may preferably contact or be positioned proximate to the working product 201 (rows of stitches of flexible filament 200) when the working product 201 is positioned between the first panel 51 and the second panel 52 when the apparatus 100A, 100B, is in the first position 91. The first work surface(s) 53A, 53B, of the first panel 51 may be positioned below the first plurality of elongated projections 10 (as perhaps best shown in FIGS. 2-4 and 8), and the second work surface(s) 54A, 54B, of the second panel 52 may be positioned below the second plurality of elongated projections 20 (as perhaps best shown in FIGS. 2-4, and 8). In some embodiments, a first panel 51 may comprise one or more, such as a plurality of, first work surfaces 53A, 53B, and a second panel 52 may comprise one or more, such as a plurality of, second work surfaces 54A, 54B. When the apparatus 100A, 100B, is in the first position 91, the first panel 51 and its first work surface(s) 53A, 53B, may be positioned proximate (within 0.1 to 0.5 inches) to the second panel 52 and its second work surface(s) 54A, 54B. When the apparatus 100A, 100B, is in the second position 92, the first panel 51 and one or more, such as all, of its first work surface(s) 53A, 53B, may be moved away from the second panel 52 and one or more, such as all, of its second work surface(s) 54A, 54B, so that one or more, such as all, of the first work surface(s) 53A, 53B, may not be positioned proximate to one or more, such as all, of its second work surface(s) 54A, 54B.

Work surfaces 53A, 53B, 54A, 54B, may be configured in any size and shape. In some embodiments, a work surface 53A, 53B, 54A, 54B, may comprise a flat or planar shape. Preferably, each first work surface 53A, 53B, may be planar in shape, and each second work surface 54A, 54B, may be planar in shape as perhaps best shown in FIGS. 2-4, and 8. Optionally, the first work surface(s) 53A, 53B, of the first panel 51 may be approximately parallel to the second work surface(s) 54A, 54B, of the second panel 52 when the apparatus 100A, 100B, is in the first position 91. Preferably, the elongated projections 11, 21, may be substantially parallel (plus or minus ten degrees) to a planar shaped work surface 53A, 53B, 54A, 54B, of the panel 51, 52, that the elongated projections 11, 21, are coupled to. For example, the elongated dimension of the elongated projections 11 of a first plurality of elongated projections 10 may be substantially parallel to a planar shaped first work surface 53A, 53B, of the first panel 51 that the elongated projections 11 are coupled to. In further embodiments, a work surface 53A, 53B, 54A, 54B, may comprise a curved, such as a convex curved shape so that the work surface 53A, 53B, 54A, 54B, may be curved towards an adjacent work surface 53A, 53B, 54A, 54B, when the apparatus 100A, 100B, is in the first position 91.

In some embodiments, a work surface 53A, 53B, 54A, 54B, may comprise a resilient material which when placed into contact with another material may contribute to a relatively high friction of coefficient between the resilient material and the other material. Preferably, a resilient material may be a natural and/or synthetic material, which is flexible to allow slight deformation and resilient so as to return to its original shape after deformation. Example resilient materials include latex rubber, silicone rubber, forms of the organic compound isoprene, such as polyisoprene, Butyl rubber, Polyacrylate Rubber, Ethylene-acrylate Rubber, Polyester Urethane, Bromo Isobutylene Isoprene, Polybutadiene, Chloro Isobutylene Isoprene, Polychloroprene, Chlorosulphonated Polyethylene, Epichlorohydrin, Ethylene Propylene, Ethylene Propylene Diene Monomer, Polyether Urethane, Perfluorocarbon Rubber, Fluoronated Hydrocarbon, Fluoro Silicone, Fluorocarbon Rubber, Hydrogenated Nitrile Butadiene, Polyisoprene, Isobutylene Isoprene Butyl, Acrylonitrile Butadiene, Polyurethane, Styrene Butadiene, Styrene Ethylene Butylene Styrene Copolymer, Polysiloxane, Vinyl Methyl Silicone, Acrylonitrile Butadiene Carboxy Monomer, Styrene Butadiene Carboxy Monomer, Thermoplastic Polyether-ester, Styrene Butadiene Block Copolymer, and Styrene Butadiene Carboxy Block Copolymer.

In some embodiments, a first work surface 53A, 53B, and/or a second work surface 54A, 54B, may comprise one or more, such as a plurality of protrusions 59, that may be formed on or coupled to the first work surface 53A, 53B, and/or a second work surface 54A, 54B. Generally, a protrusion 59 may extend above or away from a work surface 53A, 53B, 54A, 54B, and may help the work surface 53A, 53B, 54A, 54B, grip or frictionally engage a working product that it is in contact with. Preferably, protrusions 59 of a first work surface 53A, 53B, may extend above or away from the first work surface 53A, 53B, and towards the second work surface 54A, 54B, when the apparatus 100A, 100B, is in the first position 91. Preferably, protrusions 59 of a second work surface 54A, 54B, may extend above or away from the second work surface 54A, 54B, and towards the first work surface 53A, 53B, when the apparatus 100A, 100B, is in the first position 91. Protrusions 59 may be configured in any size and shape. In some embodiments, protrusions 59 may be configured as a plurality of raised bumps or other relatively small dimensioned texturing. In preferred embodiments, protrusions 59 may be elongated and may extend across all or a portion of a work surface 53A, 53B, 54A, 54B, such as between a first end 55, 57, and a second end 56, 58, of a panel 51, 52. For example, protrusions 59 may be configured as elongated ridges may extend across all or a portion of a work surface 53A, 53B, 54A, 54B.

When in the first position 91, the panels 51, 52, and the first 10 and second 20 pluralities of elongated projections may be separated by a product channel 19. In preferred embodiments, one or more opposing work surfaces 53A, 53B, 54A, 54B, and/or one or more opposing movable surfaces 63, 64, may be separated by the product channel 19. Generally, a product channel 19 may provide a space or channel that the working product 201 may move down and through as the working product 201 is moved down and away from the pluralities of elongated projections 10, 20. In preferred embodiments, a product channel 19 may separate the first 10 and second 20 pluralities of elongated projections by a distance (CD as shown in FIG. 1) of between 0.1 inches and 0.5 inches. In further embodiments, a product channel 19 may separate the first 10 and second 20 pluralities of elongated projections by a distance of between 0.1 inches and 1.0 inches.

In some embodiments, the apparatus 100A may comprise one or more hinges 71 which may enable the apparatus 100A to be moved into and between the first position 91 and the second position 92. In some embodiments, the apparatus 100A may comprise a hinge 71 that may movably couple the first panel 51 and the second panel 52 together. In preferred embodiments, the apparatus 100A may comprise a spring clamp that uses the pressure of a spring 77 to clamp and bias the apparatus into the first position 91. For example, the apparatus 100A may comprise a first handle 72 and a second handle 73 that may be movably coupled together via a hinge 71. Handles 72, 73, may be configured in any size and shape and may form comfortable surfaces for a user to grasp and exert squeezing pressure on. The handles 72, 73, may each be coupled to a clamp arm 74, 75, (e.g., clamp jaw), and each clamp arm 74, 75, may be coupled to a panel 51, 52. Clamp arms 74, 75, may be configured in any size and shape and may preferably be elongated to position the handles 72, 73, a desired distance from the panels 51, 52. The handles 72, 73, may be movably coupled together via a hinge 71, and a spring 77 may be coupled to the handles 72, 73, and/or hinge 71 so that the spring 77 may bias the apparatus 100A into the first position 91. A user may motivate the apparatus 100A into the second position 92 by squeezing the handles 72, 73, towards each other. Preferably, the clamp arms 74, 75, may be coupled to a central location on the panels 51, 52, to evenly distribute the clamping force generated by the spring across the entire working surface(s) 53A, 53B, 54A, 54B, of the panels 51, 52.

In some embodiments, a handle 72, 73, may comprise one or more handle apertures 78 which may be formed in the handle 72, 73. Handle apertures 78 may be configured in any size and shape and may face away from clamp arms 74, 75. Generally, a handle aperture 78 may be sized and shaped to receive a lower portion of a support beam 33 so that once the lower portion of a support beam 33 is inserted in the handle aperture 78 it may be retained therein so that a guide assembly 30 may be coupled, and more preferably removably coupled to a handle 72, 73.

In further embodiments, the apparatus 100A may comprise a hinge 71 that may be coupled to the first panel 51 between the first end 55 and the second end 56 and the hinge 71 may also be coupled to the second panel 52 between the first end 57 and the second end 58. In further embodiments, a hinge 71 may be coupled to two or more other elements of the apparatus 100A and may enable apparatus 100A to be moved into and between the first position 91 and the second position 92.

A hinge 71 may comprise a butt hinge, butterfly hinge, flush hinge, barrel hinge, concealed hinge, continuous hinge, T-hinge, strap hinge, double-acting hinge, Soss hinge, a flexible material hinge, or any other type or style of hinge or pivotal joining method that allows all or portions of the panels 51, 52, and all or portions of their respective plurality of elongated projections 10, 20, to be pivoted towards and away from each other. In further embodiments, a hinge 71 may comprise any type of hinge known in the art, including so-called "living" hinges, which typically comprise a linear, relatively flexible area between two relatively more rigid components, such as a line of thin plastic between thicker plastic portions, as is well known in the art.

In some embodiments, the first panel 51 and/or second panel 52 may comprise a plurality of storage apertures 61 that may be formed in an upper storage wall 62, 63, that may be coupled to a panel 51, 52. For example, a first panel 51 may comprise a first upper storage wall 62 having one or more storage apertures 61, with the first upper storage wall 62 and first work surface 53A, 53B, positioned on opposite sides of the first panel 51 and/or a second panel 52 may comprise a second upper storage wall 63 having one or more storage apertures 61, with the second upper storage wall 63 and second work surface 54A, 54B, positioned on opposite sides of the second panel 52.

In some embodiments, the first panel 51 and/or second panel 52 may comprise a lower storage wall 64, 65, that may be positioned relatively farther from the elongated projections 11, 12, than an upper storage wall 62, 63. A lower storage wall 64, 65, may comprise one or more storage depressions 66 which may be depressed into the lower storage wall 64, 65, away from an upper storage wall 62, 63. For example, a first panel 51 may comprise a first lower storage wall 64 having one or more storage depressions 66, with the first lower storage wall 64 and first work surface 53A, 53B, positioned on opposite sides of the first panel 51 and/or a second panel 52 may comprise a second lower storage wall 65 having one or more storage depressions 66, with the second lower storage wall 65 and second work surface 54A, 54B, positioned on opposite sides of the second panel 52.

Upper storage walls 62, 63, and lower storage walls 64, 65, may be configured in any size and shape. Preferably, upper storage walls 62, 63, and lower storage walls 64, 65, may be elongated in shape, and a first upper storage wall 62 may be substantially parallel (plus or minus ten degrees) with a first lower storage wall 64, and/or a second upper storage wall 63 may be substantially parallel (plus or minus ten degrees) with a second lower storage wall 65.

Storage apertures 61 may comprise openings or apertures that extend through an upper storage wall 62, 63, and be configured in any size and shape, such as rectangular in shape, circular in shape, oval in shape, etc., so that items such as crochet needles may be positioned in the storage apertures 61. Storage depressions 66 may comprise depressions or recesses in an lower storage wall 64, 65, and be configured in any size and shape, such as rectangular in shape, circular in shape, oval in shape, etc., so that a bottom portion of items such as crochet needles may rest in the storage depressions 66. As an example, a user may store their crochet needles on the apparatus 100A by inserting the crochet needles through a storage aperture 61 so that a bottom portion of the crochet needles may rest on and in the storage depressions 66.

In some embodiments, the apparatus 100A, 100B, may comprise one or more guide assemblies 30 (FIGS. 1 and 8), and each guide assembly 30 may comprise a guide aperture 31 that extends above both the first plurality of elongated projections 10 and the second plurality of elongated projections 20. A guide aperture 31 may be formed by a guide body 32. A guide aperture 31 may comprise an opening of any size and shape through which flexible filament 200 may move through. Optionally, a guide body 32 may form a conduit, channel, or other conducting configuration which may terminate in a guide aperture 31 through which flexible filament 200 may move through.

In some embodiments, the guide body 32 may be coupled to a support beam 33 that may be used to couple the guide assembly 30 to a stand strut 83, and/or to couple a tensioner assembly 40 to the guide assembly 30. In some embodiments, a guide aperture 31 and guide body 32 may be removably coupled to a support beam 33, or other element of the apparatus 100A, 100B. For example, guide aperture 31 and guide body 32 may be configured to function while being free standing, attached to a human body part, attached to another mount, etc. Generally, a guide assembly 30 may be used to provide guidance for the flexible filament 200 that is being directed or supplied to the pluralities of elongated projections 10, 20, to have the proper angle for the attacking needle 300. The guide assembly 30 may replace or function as the outstretched user finger that holds the yarn or other flexible filament 200 at the proper angle for the attacking needle 300.

A guide assembly 30 may be configured in any shape and size. In some embodiments, a guide assembly 30 may comprise a guide body 32 that may comprise a wire with a loop, twisted channel, or other hollow structure that may form the guide aperture 31. In further embodiments, a guide assembly 30 may comprise a support beam 33 that may comprise a rigid arm or structure that extends above the pluralities of elongated projections 10, 20, to which the guide body 32 may be coupled, the guide body 32 comprising a small loop or spiral of material to hold the yarn or other flexible filament 200. In further embodiments, the guide aperture 31 may extend above a tensioner assembly 40 so that the guide aperture 31 is relatively farther from the pluralities of elongated projections 10, 20, than the tensioner assembly 40.

In some embodiments, the apparatus 100A, 100B, may comprise one or more tensioner assemblies 40 (FIGS. 1 and 7) that may be coupled, such as by being removably coupled, to an element of the apparatus 100A, 100B. In preferred embodiments, a tensioner assembly 40 may be coupled to the support beam 33 of a guide assembly 30. In further embodiments, a tensioner assembly 40 may be removably coupled and/or repositionably coupled to a stand strut 83. For example, a tensioner assembly 40 may clip in to one or more fixed strut apertures 89 positioned at various intervals and location along the length of a stand strut 83. In further embodiments, a tensioner assembly 40 may be configured to function in a stand-alone fashion so that it can function without being required to be coupled to another element of the apparatus 100A, 100B. For example, a tensioner assembly 40 may be configured to function while being free-standing relative to the other elements of the apparatus, to function while being attached to a human body part, to function while being coupled to another mount, etc.

Generally, a tensioner assembly 40 may be configured to control the tension of the flexible filament 200 as it moves towards and through the guide aperture 31 of the guide assembly 30 so that the flexible filament 200 is not too slack or too tight for the user to add the flexible filament 200 to the working product 201 in a series of stitches. While crocheting, the user will usually wrap the yarn or other flexible filament 200 around their fingers to control how much tension the flexible filament 200 has. Too much tension and the flexible filament 200 will pull the previous stitches apart, too little tension and the needle 300 will not be able to make the appropriate loop or pull.

A tensioner assembly 40 may be configured to receive the flexible filament 200 so that the flexible filament 200 moves between at least two elements of the tensioner assembly 40, such as between two or more filament contact surfaces 41, 42, 43. In some embodiments, and the tensioner assembly 40 may have a first filament contact surface 41, a second filament contact surface 42, and a third filament contact surface 43, and the tensioner assembly 40 may exert a resistance to the flexible filament 200 moving through the tensioner assembly 40 by exerting a resistance to the movement of the flexible filament 200 through the tensioner assembly 40.

In preferred embodiments, as the flexible filament 200 moves through the tensioner assembly 40, the flexible filament 200 may contact and move across two or more filament contact surfaces 41, 42, 43, so that the tensioner assembly 40 may impart a frictional resistance to movement of the flexible filament 200 through the tensioner assembly 40. In further preferred embodiments, the flexible filament 200 may move across (so as to contact) the first filament contact surface 41, across the second filament contact surface 42, and across the third filament contact surface 43 as the flexible filament 200 moves through the tensioner assembly 40, and the contact of the flexible filament 200 with the filament contact surfaces 41, 42, 43, may impart a frictional resistance to movement of the flexible filament 200 through the tensioner assembly 40.

The filament contact surfaces 41, 42, 43, of a tensioner assembly 40 may be configured in any shape and size. In some embodiments, a tensioner assembly 40 may comprise one or more generally cylindrical shaped rods or bars that the one or more filament contact surfaces 41, 42, 43, may be formed or disposed on. Preferably, filament contact surfaces 41, 42, 43, may be relatively narrower at their middle and relatively wider at each end so as to generally form a channel on the one or more filament contact surfaces 41, 42, 43, to help maintain a flexible filament 200 in a central location on the one or more filament contact surfaces 41, 42, 43.

In preferred embodiments, a tensioner assembly 40 may comprise a first stabilizing rod 44, a central rod 45, and a second stabilizing rod 46, and the first filament contact surface 41 may be disposed on the first stabilizing rod 44, the second filament contact surface 42 may be disposed on the central rod 45, and the third filament contact surface 43 may be disposed on the second stabilizing rod 46. For example, a tensioner assembly 40 may comprise a first stabilizing rod 44 and a second stabilizing rod 46 that may be configured as two generally smooth cylindrical bars and one a central rod 45 preferably having a recessed channel into which the flexible filament 200 may move through so that the flexible filament 200 may wrap around a portion of the rods 44, 45, 46, in a serpentine fashion as the path for the flexible filament 200 to travel through the tensioner assembly 40. Optionally, a central rod 45 may be movably coupled, directly or indirectly, to a support beam 33 via a movable coupling 49.

In some embodiments, the apparatus 100A may comprise a stand 80 (FIGS. 5-7) which may be used to support the pluralities of elongated projections 10, 20, and panels 51, 52, above surface or object, such as a table, stand, user's lap, etc. In some embodiments, a stand 80 may comprise two strut supports 81, 82, which may couple a stand strut 83 to stand blocks 85, 86, and/or to stand top plate 87.

Strut supports 81, 82, may be configured in any size and shape to separate a stand strut 83 a desired distance from stand blocks 85, 86, and/or stand top plate 87. For example, strut supports 81, 82, may be generally triangular in shape, configured as bars or rods, etc. Optionally, a stand 80 may comprise stand blocks 85, 86, which may be coupled to strut supports 81, 82, and a stand top plate 87. Stand blocks 85, 86, may be configured in any size and shape. Preferably, a stand 80 may comprise a stand top plate 87 which may provide a flat area for supporting the other elements of the stand 80. A stand top plate 87 may be configured in any shape and size, such as a generally rectangular plate. Preferably, a stand 80 may comprise a stand wheel 88 which may be rotatably coupled, such as via an axle, bearing, etc., to a stand top plate 87 so that the stand top plate 87 and stand wheel 88 may be rotated relative to each other. This may allow the stand strut 83 and panels 51, 52, and the pluralities of elongated projections 10, 20, to be easily spun or rotated relative to a surface or object that the stand 80 is resting on. For example, a user may rotate or spin the stand top plate 87 in order to rotate or spin the pluralities of elongated projections 10, 20, and panels 51, 52, above surface or object, such as a table, stand, user's lap, etc. that the stand wheel 88 may be resting on. Optionally, the stand top plate 87 and stand blocks 85, 86, may be magnetically coupled together.

A stand strut 83 may be configured in any size and shape, such as an elongated length of material that may be coupled to one or more strut supports 81, 82. Preferably, a stand strut 83 may comprise a coupling surface 84, and the coupling surface 84 may be positioned to or proximate to a panel 51, 52, that may be coupled to the stand strut 83. Optionally, a coupling surface 84 may extend across all or portions of the stand strut 83, and optionally, a coupling surface 84 may be generally flat or planar in shape.

In some embodiments, a stand strut 83 may comprise one or more strut apertures 89 which may be formed in the stand strut 83. Strut apertures 89 may be configured in any size and shape and may face away from stand blocks 85, 86, stand top plate 87, and stand wheel 88. Generally, a strut aperture 89 may be sized and shaped to receive a lower portion of a support beam 33 so that once the lower portion of a support beam 33 is inserted in the strut aperture 89 it may be retained therein so that a guide assembly 30 may be coupled, and more preferably removably coupled to the stand strut 83.

In some embodiments, one or both panels 51, 52, may be removably coupled to the stand strut 83. In preferred embodiments, a panel 51, 52, may be removably coupled to the stand strut 83 via a magnetic coupling method. For example, a panel 51, 52, may comprise panel magnetic material 67, the stand strut 83 may comprise stand magnetic material 90, and the panel magnetic material 67 and stand magnetic material 90 may be capable of magnetically adhering to each other through the principle of magnetism. Preferably, panel magnetic material 67 may be coupled to a panel 51, 52, so that the panel magnetic material 67 and work surface 53A, 53B, 54A, 54B, may be positioned on opposite sides of the panel 51, 52, and so that the panel magnetic material 67 may be positioned between an upper storage wall 62, 63, and a lower storage wall 64, 65. Optionally, a panel 51, 52, may be made from or may comprise a magnetic material. Preferably, stand magnetic material 90 may be coupled to a coupling surface 84 of a stand strut 83. Optionally, a stand strut 83 may be made from or may comprise a magnetic material. Stand magnetic material 90 is configured to be removably coupled to panel magnetic material 67 via the principle of magnetism.

In some embodiments, a magnetic material 67, 90, may be or may comprise a high-coercivity ferromagnetic compound type of magnetic material such as ferric oxide mixed with a plastic binder. In further embodiments, magnetic materials 67, 90, may include: ferrite, manganese-zinc ferrite, nickel-zinc ferrite, strontium ferrite, cobalt ferrite, barium ferrite, magnetic alloys such as alnico, comol, Hypernom® magnetic alloy, manganese-zinc ferrite, iron-silicon magnet alloys, nickel-zinc ferrite, ferritic stainless steel alloys, strontium ferrite, barium ferrite, alnico, iron-silicon magnet alloy, Chromindur® (Chromium-Cobalt-Iron) alloys, Silmanal (Silver-Manganese-Aluminium) alloys, Platinax II (platinum-cobalt) alloy, Bismanol (manganese bismuthide) alloy, cobalt-platinum alloys, chromium-manganese antimonide alloy, vectolite (cobalt ferrite), magnadur (sintered barium ferrite), lodex (oxide-coated iron-cobalt particles), awaruite (Ni2Fe to Ni3Fe nickel-iron alloy), wairauite, rare earth magnets such as samarium-cobalt, cesium-cobalt, neodymium-iron-boron, other neodymium magnet materials, metallic oxides such as magnetite, ulvospinel, hematite, ilmenite, maghemite, jacobsite, iron sulfides such as pyrrhotite, greigite, troilite, metallic oxyhydroxides such as goethite, lepidocrocite, feroxyhyte, ferrimagnetic materials such as magnetite, pyrrhotite, cubic ferrites, hexagonal ferrites, ferromagnetic materials including metals such as iron, nickel, cobalt, metal alloys containing iron, nickel, and/or cobalt, soft magnetic materials, hard magnetic materials, or any other suitable magnetic material, that is capable of magnetically adhering to another magnetic material through the principle of magnetism.

In some embodiments, the apparatus 100B may comprise a glove 97 (FIG. 8), and a first panel 51, and its first plurality of elongated projections 10, and a second panel 52, and its second plurality of elongated projections 20, may be coupled to the glove 97. A glove 97 may comprise a covering for the hand worn and typically having separate parts for the thumb and one or more, such as each, finger of a hand.

Preferably, a glove 97 may comprise a glove thumb 98 and one or more glove fingers, such as a first glove finger 99A, a second glove finger 99B, a third glove finger 99C, and a fourth glove finger 99D. A glove thumb 98 may be configured to cover all or a part, e.g., having an open tip, of a user's thumb. Likewise, glove fingers 99A, 99B, 99C, 99D, may be configured to cover all or a part, e.g., having an open tip, of a user's fingers. In preferred embodiments, the first panel 51 may be coupled to the glove thumb 98, and the second panel 52 may be coupled to a first glove finger 99A, the first glove finger 99A configured to receive at least a portion of a user's index finger. In further embodiments, the first panel 51 may be coupled to the glove thumb 98, and the second panel 52 may be coupled to at least one glove finger 99A, 99B, 99C, 99D.

Preferably, a glove 97 may be made from or may comprise a flexible material so that the glove thumb 98 and glove finger 99A, 99B, 99C, 99D, may be moved towards and away from each other. In this manner, by moving the glove thumb 98 (and its first panel 51 and first plurality of elongated projections 10) and glove finger 99A, 99B, 99C, 99D (and its second panel 52 and second plurality of elongated projections 20) proximate to each other, the apparatus 100B may be moved into the first position 91, and by moving the glove thumb 98 (and its first panel 51 and first plurality of elongated projections 10) and glove finger 99A, 99B, 99C, 99D (and its second panel 52 and second plurality of elongated projections 20) away from each other, the apparatus 100B may be moved into the second position 92. Preferably, a glove 97 may be made from or may comprise a flexible material that may include various types of flexible plastics such as polyvinyl chloride, natural or synthetic rubber, synthetic fabrics such as polyester, acrylic, nylon, rayon, acetate, spandex, spandex blends, and Kevlar, and natural fabrics such as coir, cotton, hemp, jute, canvas, flax, leather, linen, ramie, wool, silk, or any other suitable flexible natural or synthetic material including combinations of materials.

While some exemplary shapes and sizes have been provided for elements of the apparatus 100A, 100B, it should be understood to one of ordinary skill in the art that the elongated projections 11, 21, guide assembly 30, tensioner assembly 40, panels 51, 52, stand 80, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100A, 100B, may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100A, 100B, may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100A, 100B, may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100A, 100B, may be coupled by being one of connected to and integrally formed with another element of the apparatus 100A, 100B.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A crochet assistance apparatus for supporting a flexible filament, the apparatus comprising:

a first plurality of elongated projections, wherein the first plurality of elongated projections is coupled to a first panel;

a second plurality of elongated projections, wherein the second plurality of elongated projections is coupled to a second panel; and a first handle and a second handle, wherein the first handle is coupled to a first clamp arm, wherein the second handle is coupled to a second clamp arm, wherein the first clamp arm is coupled to a central location on the first panel, wherein the second clamp arm is coupled to a central location on the second panel, wherein the first handle and the second handle are coupled together via a hinge, wherein a spring is coupled to at least one of the first handle and the second handle, wherein the apparatus is movable between a first position and a second position, wherein the apparatus is biased in the first position via the spring, wherein each elongated projection of the first plurality of elongated projections is proximate to the second plurality of elongated projections when the apparatus is in the first position, and wherein one or more elongated projections of the first plurality of elongated projections is moved out of being proximate to the second plurality of elongated projections when the apparatus is in the second position, wherein a portion of the first panel is relatively closer to the second panel when the apparatus is in the first position, and wherein the portion of the first panel is relatively farther from the second panel when the apparatus is in the second position.

2. The apparatus of claim 1, wherein each elongated projection in the first plurality of elongated projections and each elongated projection in the second plurality of elongated projections comprises a resilient material.

3. The apparatus of claim 1, wherein the elongated projections in the first plurality of elongated projections are arranged in a first linear array, and wherein the elongated projections in the second plurality of elongated projections are arranged in a second linear array.

4. The apparatus of claim 3, wherein the first linear array and the second linear array are both straight linear in shape.

5. The apparatus of claim 4, wherein the first linear array and the second linear array are substantially parallel when the apparatus is in the first position.

6. The apparatus of claim 1, wherein the elongated projections in the first plurality of elongated projections are uniformly spaced apart.

7. The apparatus of claim 6, wherein the elongated projections in the second plurality of elongated projections are uniformly spaced apart.

8. The apparatus of claim 1, wherein the first panel has a first work surface and the second panel has a second work surface, wherein the first work surface is positioned below the first plurality of elongated projections, and wherein the second work surface is positioned below the second plurality of elongated projections.

9. The apparatus of claim 8, wherein the first work surface is planar in shape, and wherein the second work surface is planar in shape.

10. The apparatus of claim 8, wherein the first work surface comprises a first protrusion that is positioned below the first plurality of elongated projections, and wherein the second work surface comprises a second protrusion that is positioned below the second plurality of elongated projections.

11. The apparatus of claim 1, further comprising an upper storage wall and a lower storage wall that are each coupled to the first panel, wherein the upper storage wall comprises a storage aperture, and wherein the lower storage wall comprises a storage depression.

12. The apparatus of claim 1, further comprising a base, wherein a panel selected from the first panel and the second panel is removably coupled to the base.

13. The apparatus of claim 12, wherein the panel selected from the first panel and the second panel comprises a panel magnetic material, wherein the base comprises a stand magnetic material that is configured to be removably coupled to the panel magnetic material via the principle of magnetism.

14. A crochet assistance apparatus for supporting a flexible filament, the apparatus comprising:

a first plurality of elongated projections a second plurality of elongated projections, wherein the apparatus is movable between a first position and a second position, wherein each elongated projection of the first plurality of elongated projections is proximate to the second plurality of elongated projections when the apparatus is in the first position, and wherein one or more elongated projections of the first plurality of elongated projections is moved out of being proximate to the second plurality of elongated projections when the apparatus is in the second position, wherein the first plurality of elongated projections is coupled to a first panel, wherein the second plurality of elongated projections is coupled to a second panel, wherein a portion of the first panel is relatively closer to the second panel when the apparatus is in the first position, and wherein the portion of the first panel is relatively farther from the second panel when the apparatus is in the second position; and a glove having at least one glove finger, wherein the first panel and the second panel are each coupled to the glove.

15. The apparatus of claim 14, wherein the elongated projections in the first plurality of elongated projections are arranged in a first linear array, and wherein the elongated projections in the second plurality of elongated projections are arranged in a second linear array.

16. The apparatus of claim 15, wherein the first linear array is straight linear in shape and the second linear array is straight linear in shape.

17. The apparatus of claim 16, wherein the elongated projections in the first plurality of elongated projections are uniformly spaced apart, and wherein the elongated projections in the second plurality of elongated projections are uniformly spaced apart.

18. The apparatus of claim 14, wherein the first panel has a first work surface and the second panel has a second work surface, wherein the first work surface is positioned below the first plurality of elongated projections, wherein the second work surface is positioned below the second plurality of elongated projections, wherein the first work surface is planar in shape, and wherein the second work surface is planar in shape.

19. The apparatus of claim 8, wherein the first work surface contacts the second work surface when the apparatus is in the first position.

* * * * *